United States Patent [19]

Cailloux

[11] 3,965,842

[45] June 29, 1976

[54] GRIPPING DEVICE FOR A SUSPENDED LOAD

[75] Inventor: Jean Guy Cailloux, Six-Fours-la-Plage, France

[73] Assignee: Etat Francais, France

[22] Filed: Feb. 19, 1975

[21] Appl. No.: 551,024

[30] Foreign Application Priority Data

Mar. 5, 1974 France ..... 74.07350

[52] U.S. Cl. ..... 114/235 R; 114/43.5 VC

[51] Int. Cl.[2] ..... B63B 21/56

[58] Field of Search ..... 9/30–32; 114/43.5 VC, 43.5 R, 235 R, 235 B, 72, 51, 44–45, .5 R, 230; 254/143; 214/15 R; 61/69 R; 244/137 R

[56] References Cited

UNITED STATES PATENTS

| | | | |
|---|---|---|---|
| 1,776,210 | 9/1930 | Wortmann | 114/51 |
| 3,316,871 | 5/1967 | Tucker | 114/.5 R |
| 3,450,279 | 6/1969 | Yukama | 114/72 |
| 3,629,963 | 12/1971 | Itami | 61/69 R |

*Primary Examiner*—Trygve M. Blix
*Assistant Examiner*—Sherman D. Basinger
*Attorney, Agent, or Firm*—Stevens, Davis, Miller & Mosher

[57] ABSTRACT

A gripping device for controlling the movements of a load suspended from a cable during the operations of placing the load in the water or hoisting the load from the water includes two flat straps stretched across the lower opening of a well in a ship. Each strap is held taut by cables which pass over return pulleys and are wound onto constant-tension winches located on opposite sides of the upper end of the well in the ship.

12 Claims, 4 Drawing Figures

GRIPPING DEVICE FOR A SUSPENDED LOAD

The object of the present invention is a gripping device for guiding a load, particularly a load of elongated shape having a plane of longitudinal symmetry, suspended from a cable while controlling its movements during the operation of bringing it alongside the ship or placing it in the water.

The technical field of the invention is that of the construction of sea handling and hoisting apparatus.

Use is being made to an ever greater extent of immersed bodies towed by a ship or lowered in depth to effect determinations of measurements at sea. These immersed bodies, referred to as fish, are for instance sonars for exploring the bottom of the sea and detecting or recognizing immersed or submersible objects. They may also be bodies bearing geophysical or geological surveying apparatus, such as apparatus for effecting oceanographical measurements or pressurized turrets for lowering divers into the sea.

The development of the exploration for oil in the sea is resulting in an increase in the use of such bodies which are towed or lowered into the sea from a vessel.

The placing in the water and recovery of these immersed bodies raises difficult problems. As a matter of fact the swell of the sea produces movements between the vessel and the immersed body which may damage the body by impact with the vessel.

The use of vessels provided with a central well is tending to increase because of the facilities which such a well presents for lowering, at sea, a turret or a load suspended from a cable or for towing an immersed body. This central well is of reduced dimensions and the floating body must be guided carefully during the operations of placing the body in the sea and of raising the body up again through the central well.

The object of the present invention is to provide a simple gripping device which makes it possible to control the movements of a load suspended from a cable during the operations of placing the load in the sea and lowering the load below a vessel. The device may be used on board a vessel, a drill platform or even along a pier.

The objects of the invention are achieved by means of at least two straps, located on opposite sides of the suspension cable and stretched above the load across a passage taken by the load during the movements of hoisting it out of the water or of placing it in the water.

In the event that a central well is used for the operations of placing the load in the water and recovery, the straps are stretched across the well preferably substantially across the lower opening thereof below the surface of the water.

The straps may either be elastic or be fastened at their two ends to elastic devices or else may be subjected at their two ends to a constant tension.

In the case of a central well, each strap can pass over two return rollers placed on opposite sides of the lower opening of the well and be maintained under a substantially constant tension.

The means for maintaining the tension of the straps constant comprises either two winches of substantially constant tension, regardless of the direction of rotation of the winches, placed on opposite sides of the upper opening of the well, or devices which are flexible in translation, for instance springs or jacks assuring a substantially constant return force, regardless of elongation.

In the case of a central well, the length of the straps may be limited to the width of the well. In this case the straps are fastened at each to at least one cable passing over a return pulley. The return pulleys are placed on opposite sides of the lower opening of the well and the cables are maintained under substantially constant tension. For example, the cables wind up on winches of substantially constant tension located on opposite sides of the upper opening of the well.

The winches may be replaced by equivalent tensioning devices such as jacks or springs.

The straps used are preferably flat straps so as to distribute the pressure over a larger surface. Each of these flap straps is then fastened to two cables passing over two return pulleys and held under substantially constant tension.

In a further embodiment, the device comprises means for varying the height of the straps in the well so as to free or clear the lower end of the well. These means comprise, for example, vertically sliding carriages on which the return pulleys or rollers for the straps or cables are mounted.

Thus the straps may slide vertically in the well at the same time as the load is hoisted and after the load has penetrated sufficiently into the well to deform the straps.

Conversely, the return rollers or pulleys may descend at the same time as the load upon placing it in the water. These carriages preferably comprise a device for locking in any position whatsoever which is controlled from the top of the well.

The various carriages may be placed by a single frame sliding vertically in the well and on which the return rollers or pulleys are fastened. The carriages or the single frame are arranged in such a manner that they do not impede the passage of the load.

In the event that the handling of the load is effected at the periphery of the vessel, the movements of the load are controlled by means of a device formed of a frame, fastened to the periphery of the vessel and of sufficient dimensions not to interfere with the passage of the load, and at least two straps stretched across the frame.

The result of the invention is a new device for the gripping and guiding of a load suspended from a cable upon its entrace into or departure from a passage provided in a vessel and used by it at the time of the maneuvers for the lowering of said load below the vessel or the raising of the load again into the vessel.

The principle action of the straps is, on the one hand, to decrease the relative movements of the load with respect to the well and, on the other hand, to center it in the well.

These relative movements are due to the pitching and rolling movements of the ship, the perpendicular movement of the load which depends on the length of the cable to the end of which it is hooked, and the movement of the load around its point of attachment to the cable. All of these relative movements are reduced considerably as soon as the load has started to penetrate into the well and has therefore started to deform the straps.

As a matter of fact, when a strap is deformed by the load, it exerts on the latter a force which opposes that deformation. This force is proportional to the amount of deformation on the one hand and to the tension to which the strap is subjected on the other hand i.e., the force is greater with more pronounced deformation and greater with increased tension.

If the load is subjected to a movement of pitching around its point of attachment to the cable, it periodically deforms the two straps so that each time they exert a force for the same period as, but which opposes, this deformation. Likewise, if the vessel pitches, the effect of the straps will be to force the load to follow the movement of the ship.

If the ship rolls, the combined action of the forces exerted by the straps and the force exerted by the cable for the suspension of the load compels the load to follow the movement of the ship.

If the load presents itself diagonally in the well, the forces of the strap bring it back into position.

The straps oppose the load moving from front to rear or from one side to the other. The straps reduce the pendulum movements which the suspension cable would have in the absence of straps.

In general, one encounters the combination of all of these phenomena. The action of the straps, combined or not with that of the suspension cable, has the effect of decreasing all the relative movements of the load with respect to the well.

During the displacement of the ship from one point to another, the straps may remain under tension so that they again fulfill their function as a guide and anti-swinging device when the load is again put into the water.

In the preferred embodiment, in which the straps are fastened to cables wound on constant-tension winches, the tension can be relaxed when the load has been removed from the water and placed on a storage cradle. When a load is again placed in the water, the straps can be placed again under tension before starting the lowering movement which is then guided.

The straps in accordance with the invention, located at the bottom of a central well, also serve to brake the rising movement of a towed immersed body. As a matter of fact, when it is located in a region of about 15 m below the ship, the towed body tends to assume very substantial pendulum movements from the front to the rear. These movements are substantially dampened if the speed of ascent is maintained at a high value, avoiding any sudden stop or acceleration. The towed body thus enters into the well with a relatively high speed of the order of 0.5 m/second.

The straps exert an increasing braking force on the towed body, imparting to it a rapid progressive deceleration, with the speed changing for example from 0.5 m/second to 0 within 2 meters.

The straps make it possible to detect the arrival of the load at the bottom of the well and automatically to control the reduction of the speed of the traction winch of the suspension cable and, if necessary, to stop it at any height in the well.

The following description refers to the accompanying drawings which show, by way of illustration and not of limitation, one gripping device in accordance with the invention installed in the central well of a ship.

Figure 2:
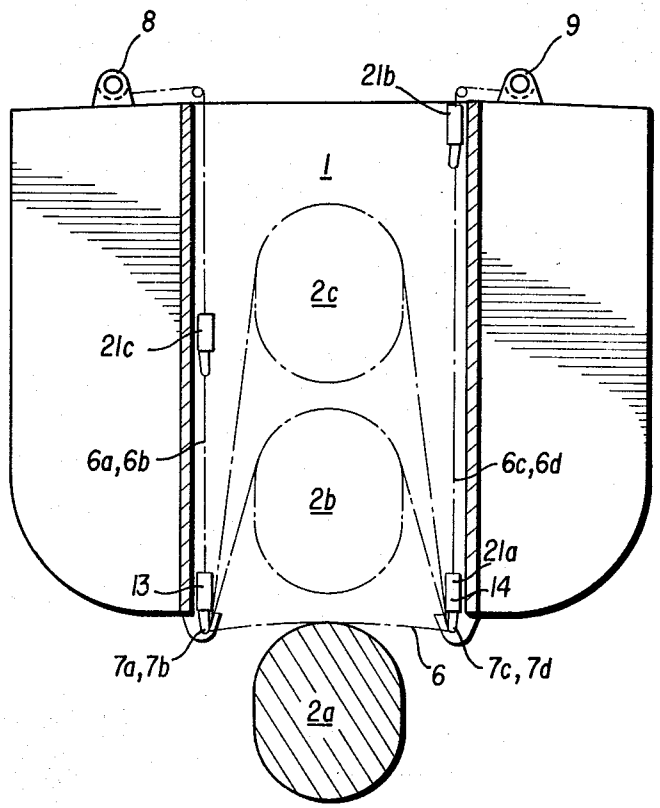
FIG. 2 is a cross section along the line 2–2 of FIG. 1.
Figure 1:
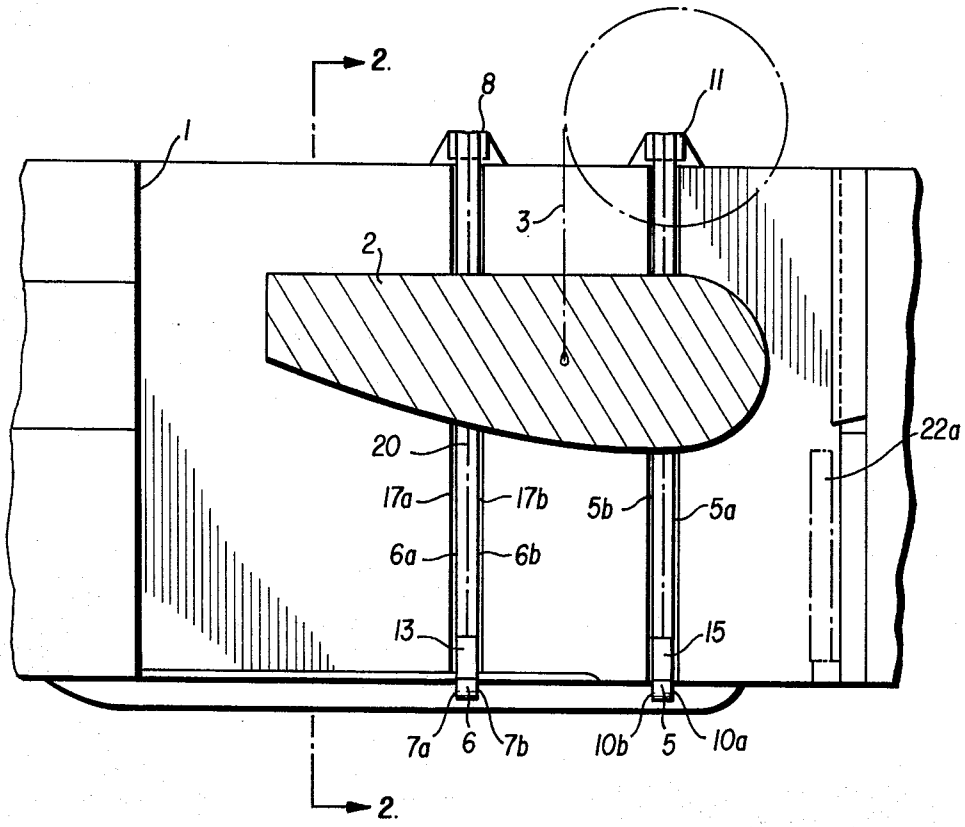
FIG. 1 is a longitudinal section through the central well.

FIGS. 1 and 2 show a vertical well 1, located substantially at the center of a ship, in which there is arranged a floating body 2 suspended from a cable 3 passing over a pulley 4. This floating body is intended, for instance, to be towed by the ship.

The gripping device in accordance with the invention comprises two wide flat straps 5 and 6 which are stretched transversely across the lower opening of the well on both sides of the suspension and tow cable 3. The strap 6 is fastened at each of its two ends to two cables 6*a*, 6*b* on the one side and 6*c*, 6*d* on the other side.

The cables or ropes 6*a*, 6*b* pass over two return pulleys 7*a*, 7*b* and wind up on a constant-tension winch 8 located on one side of the upper opening of the well.

The cables or ropes 6*c*, 6*d* pass over two return pulleys 7*c*, 7*d* and wind up on another constant-tension winch 9 located opposite the winch 8 on the other side of the upper opening of the well.

Likewise the strap 5 is fastened, at one end, to cables or ropes 5*a*, 5*b* which pass over return pulleys 10*a*, 10*b* and wind up on a constant-tension winch 11 and, at the other end, to cables 5*c*, 5*d* which pass over return pulleys 10*c*, 10*d* and wind up on a constant-tension winch 12.

FIG. 2 shows three successive positions occupied by the body 2 during the rising movement.

In the position 2*a*, the body 2 is entirely within the water and returns into contact with the straps which are held taut by the winches.

In position 2*b*, the body 2 has penetrated into the well and the straps have deformed to surround the top of the body 2. The resultant force of the tension exerted on the straps retards the ascent of the body and opposes the swinging thereof. The position 2*c* corresponds to the storage position of the body 2 in the well during the displacements of the ship. In this position the body 2 can be placed on a cradle (not shown).

In the event that the load is towed through a central well, the straps, placed across the lower opening of the well, interfere with the movement of the tow cable. In order to avoid this, one can add to the device means which make it possible to raise the straps up to the upper portion of the well. For example, each strap is connected to a handling cable wound on a drum identical to that of the constant-tension winches 8, 9, 11 and 12 and mounted on the same shaft. A spring is interposed between the end of this handling cable and its point of attachment to the strap assures substantially constant tension.

Thus in order to raise or lower the straps it is sufficient to control the direction of rotation of the winches 8, 9, 11 and 12. The stopping of the straps in upper position takes place automatically. The time used to move from the top position to the bottom position is as short as possible.

In the embodiment shown, the pairs of return pulleys 7*a*, 7*b* on the one hand and 7*c*, 7*d* on the other hand are each mounted on carriages 13 and 14 respectively.

Likewise the pairs of pulleys 10*a*, 10*b* and 10*c*, 10*d* are mounted on carriages 15 and 16.

Figure 4:
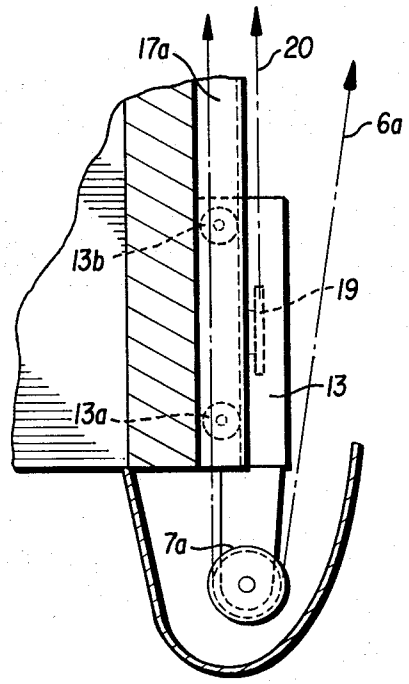
FIG. 4 is a view, on a larger scale, of a detail of FIG. 2.
Figure 3:
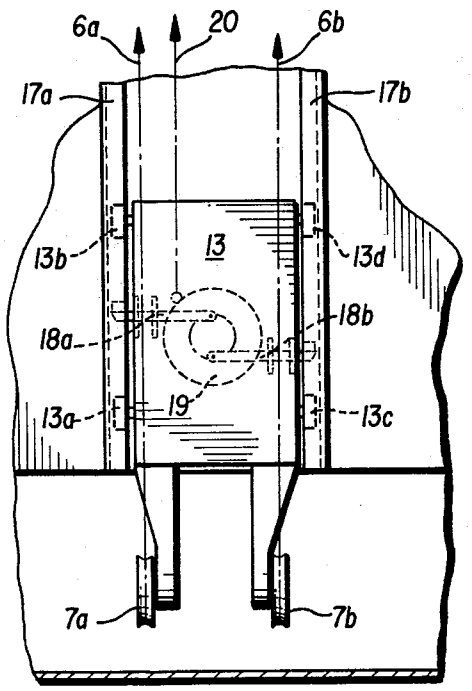
FIG. 3 is a view on a larger scale of a detail of FIG. 1.

FIGS. 3 and 4 show one of these carriages on a larger scale, for instance the carriage 13, shown in elevation and in side view respectively.

The carriage 13 is mounted on four rollers 13*a*, 13*b*, 13*c*, 13*d* which roll in two vertical slideways 17*a* and 17*b*. It has a locking device formed of two arms 18*a* and 18*b* which engage in the slideways and are mounted eccentrically on a pivoting disk 19. An operating cable 20, fastened to the periphery of the disk 19, makes it possible from the top of the well to control the pivoting of the disk 19 and the locking of the carriage 13. A return spring returns the disk to the locking position when the tension of the cable 20 is relaxed.

When the carriage is unlocked, the tension of the cables 6*a* and 6*b* causes the displacements of the carriage in the slideways in upward direction. The carriage descends again under the action of its weight.

FIG. 2 shows three positions of the sliding carriages. The lower position, position 21*a*, is the position of maintaining the straps in low position during the bringing of the body 2 alongside the ship.

The top position 21*b* is the position of the carriages during the towing so that the straps do not interfere with the longitudinal movement of the tow cable.

Only the carriages which support the rear strap are brought into this position, as the front strap does not interfere with the movement of the cable.

The intermediate position 21 is the position which the carriages occupy during the maneuvers for the opening or closing of the doors 22*a* and 22*b* which partially close off the bottom of the well. In FIG. 1 only the front door 22*a* has been shown. In this case only the front strap 5 interferes with the operating of the door 22*a* and only the carriages 15 and 16 supporting this strap are brought into the intermediate position 21*c*.

Of course, various equivalent modifications can be made by the man skilled in the art in the embodiment which has been described above, solely by way of example, without thereby going beyond the scope of the invention.

What is claimed is:

1. A gripping device for controlling the movements of a load suspended from a cable during the operation of bringing the load on board a ship or lowering the load below a ship, said device comprising:

at least two straps located on opposite sides of the cable and tensioned, above the load, across a passage in which the load moves when hoisted out of the water or placed in the water, one end of each of said straps being connected to means connected to one side of the passage and the other end of each of said straps being connected to means connected to the side of the passage opposite said one side thereof.

2. A gripping device as claimed in claim 1, wherein: said straps are elastic.

3. A gripping device as claimed in claim 1, wherein: said straps are fastened at each end thereof to an elastic device.

4. A gripping device for controlling the movements of a load suspended from a cable during the lowering of the load below a ship having a central well and the raising of the load through the central well, said device comprising:

at least two straps located on opposite sides of the cable and tensioned, above the load, substantially across the well, one end of each of said straps being connected to means connected to one side of the well and the other end of each of said straps being connected to means connected to the side of the well opposite said one side thereof.

5. A gripping device as claimed in claim 4, wherein:

said straps are tensioned substantially across the lower opening of the well below the surface of the water.

6. The gripping device as claimed in claim 4, further comprising:

means for varying the height of the straps in the well so that said straps may clear the lower end of the well.

7. A gripping device for controlling the movements of a load suspended from a cable during the lowering of the load below a ship having a central well and the raising of the load through the central well, said device comprising:

at least two straps located on opposite sides of the cable and tensioned, above the load, substantially across the lower opening of the well below the surfaces of the water, and said straps pass over return pulleys positioned on opposite sides of the lower opening of the well and are held by means for imparting a constant tension to the straps.

8. The gripping device as claimed in claim 7, wherein:

said straps comprise flat straps, each end of which is fastened to two cables passing over two return pulleys.

9. A gripping device for controlling the movements of a load suspended from a cable during the lowering of the load below a ship having a central well and the raising of the load through the central well, said device comprising:

at least two straps located on opposite sides of the cable and tensioned, above the load, substantially across the well, said straps are fastened, at each end thereof, to at least one cable passing over a return pulley, said pulleys being located on opposite sides of the lower opening of the central well, and said cables are wound upon a respective one of two constant-tension winches located on opposite sides of the upper opening of the well.

10. A gripping device for controlling the movements of a load suspended from a cable during the lowering of the load below a ship having a central well and the raising of the load through the central well, said device comprising:

at least two straps located on opposite sides of the cable and tensioned, above the load, substantially across the well and vertically sliding carriages, which carry return rollers and return pulleys, for varying the height of the straps in the well so that said straps may clear the lower end of the well.

11. The gripping device as claimed in claim 10, wherein:

each of said carriages comprises a locking device controlled by a control cable from the top of the well.

12. The gripping device as claimed in claim 11, wherein:

each of said locking devices comprises two arms mounted eccentrically on a pivotable disk fastened to the respective carriage, each of said control cables being fastened to the periphery of its respective disk to control the rotation of the disk from the top of the well whereby upon rotation of the disk the arms are locked on slideways in which the respective carriage slides.

* * * * *